US005849082A

United States Patent [19]

Stefani

[11] Patent Number: 5,849,082

[45] **Date of Patent: *Dec. 15, 1998**

[54] ROTARY GLAZING MACHINE, IN PARTICULAR FOR CERAMIC TILES

[75] Inventor: Franco Stefani, Sassuolo, Italy

[73] Assignee: Ronflette S.A., Luxembourg, Luxembourg

[ * ] Notice: The term of this patent shall not extend beyond the expiration date of Pat. No. 5,477,781.

[21] Appl. No.: 802,084

[22] Filed: Feb. 19, 1997

[30] Foreign Application Priority Data

Jul. 29, 1996 [IT] Italy ..... M096A0105

[51] Int. Cl.[6] ..... B05C 1/08; B41F 9/00

[52] U.S. Cl. ..... 118/212; 118/261; 118/259; 118/255; 101/153; 101/36; 101/170; 101/37

[58] Field of Search ..... 118/211, 212, 118/244, 255, 259, 261, 264, 413, 223; 101/153, 36, 37, 157, 170, 376

[56] References Cited

U.S. PATENT DOCUMENTS

| | | | |
|---|---|---|---|
| 4,287,849 | 9/1981 | Walchhuetter | 118/602 |
| 5,476,545 | 12/1995 | Schrauwers et al. | 118/668 |
| 5,477,781 | 12/1995 | Stefani | 101/153 |

FOREIGN PATENT DOCUMENTS

| | | |
|---|---|---|
| 0677364 | 10/1995 | European Pat. Off. . |
| 3313641 | 10/1984 | Germany . |
| 4327421 | 2/1995 | Germany . |
| 07116577 | 5/1995 | Japan . |
| 2207092 | 1/1989 | United Kingdom . |

*Primary Examiner*—David A. Simmons
*Assistant Examiner*—Calvin Padgett
*Attorney, Agent, or Firm*—Browdy and Neimark

[57] ABSTRACT

The invention relates to a rotary glazing machine, in particular for ceramic tiles, which comprises a mobile rest plane for tiles on which the tiles are translated in a predetermined direction, and a rotary glazing apparatus situated superiorly to the rest plane. The glazing apparatus comprises, set at a short distance one from another: a first cylinder, rotatable about an axis thereof, provided with an elastically deformable peripheral portion on which the glaze is deposited, subsequently to be transferred on to an underlying tile due to an undragging contacting rotation motion on an upper surface of a tile; a second cylinder, rotatable about an axis thereof and provided with an elastically deformable peripheral portions, having an external cylindrical surface which is predisposed to receive the glaze to be laid at least in part on the tile; the second cylinder being positioned in order to come into contact with the glaze already deposited on the tile by the first cylinder by dragging contact therewith of the external cylindrical surface thereof.

12 Claims, 3 Drawing Sheets

32
33
37
7
2
43
42
4
47
3
2
1
2
8
6
5

36
35
31
3
4
41
45
46
36
35
2
2
2
45
46

ROTARY GLAZING MACHINE, IN PARTICULAR FOR CERAMIC TILES

BACKGROUND OF THE INVENTION

The invention relates to a rotary glazing machine, especially for ceramic tiles. Specifically, but not exclusively, it is for use in ceramic tile glazing operations involving distributing a coat of glaze over at least a part of the upper surface of the single tiles.

Various procedures and different glazing machines are at present used for this task. One of the above-mentioned processes spreads the coat of glaze on the tiles by means of a system known as "the bell system", in which the tiles transit along a conveyor line at a predetermined speed and pass below a double veil of falling glaze which has a shape characteristic of a bell, hence the term. This method is very commonly used and leaves a smooth and uniform coat of glaze on the central part of the tiles. In proximity of the edges, however, the coat of glaze is less uniformly distributed. Also, the glaze piles up on the edges of the tiles, so that it has to be scraped away, obviously requiring special tools therefor, and leading to considerable wastage of glaze since the scrapings cannot be reused.

The upturned cup-shaped element, or "bell", from which the glaze is caused to drop, obviously has to be frequently and regularly cleaned.

In all cases the aim is to distribute a coat of glaze evenly over the entire surface of the tile.

The "threader" system has like characteristics.

Another system used lays the glaze over the whole tile surface by means of special rotating discs which separate the glaze into tiny droplets directed in all directions and especially towards the surface of the tile, so as to cover same entirely. This system is principally used for floor tiles and enables a sufficiently uniform and rough-surfaced layer of glaze to be laid over the entire surface of the tiles. The roughness of the finished coat of glaze might cause problems in the laying of further decorations on the tile surface.

SUMMARY OF THE INVENTION

The present invention, as it is characterised in the claims that follow, obviates the limitations and drawbacks in the known art by providing a machine in which the glaze laying is operated by two cylinders arranged in succession, one after the other, which machines are provided with an elastically-deformable peripheral part which comes into contact with the tile. The first of the two cylinders is predisposed to lay the glaze on the tile by rolling on a surface thereof, while the second cylinder rotates draggingly on the tile immediately after the first cylinder. Thus a uniform layer of glaze is deposited on the tile surface.

A further advantage of the invention consists in the fact that the edges of the tiles need no cleaning up, which affords a considerable saving of glaze and totally eliminates the need for a drip-collecting machine, which instead are provided on existing lines in the prior art.

A further advantage of the present invention is constituted by the fact that it allows for "selective" glazing of raised surfaces on the tile, with, obviously, recessed sections of the tile surface being left free of glaze. The recessed sections of the tile surface can be glazed, however, if so desired.

BRIEF DESCRIPTION OF THE DRAWINGS

Further characteristics and advantages of the present invention will better emerge from the detailed description that follows of a preferred but non-exclusive embodiment of the invention, illustrated purely by way of non-limiting example in the accompanying figures of the drawings, in which.

DESCRIPTION OF THE PREFERRED EMBODIMENTS

Figure 1:
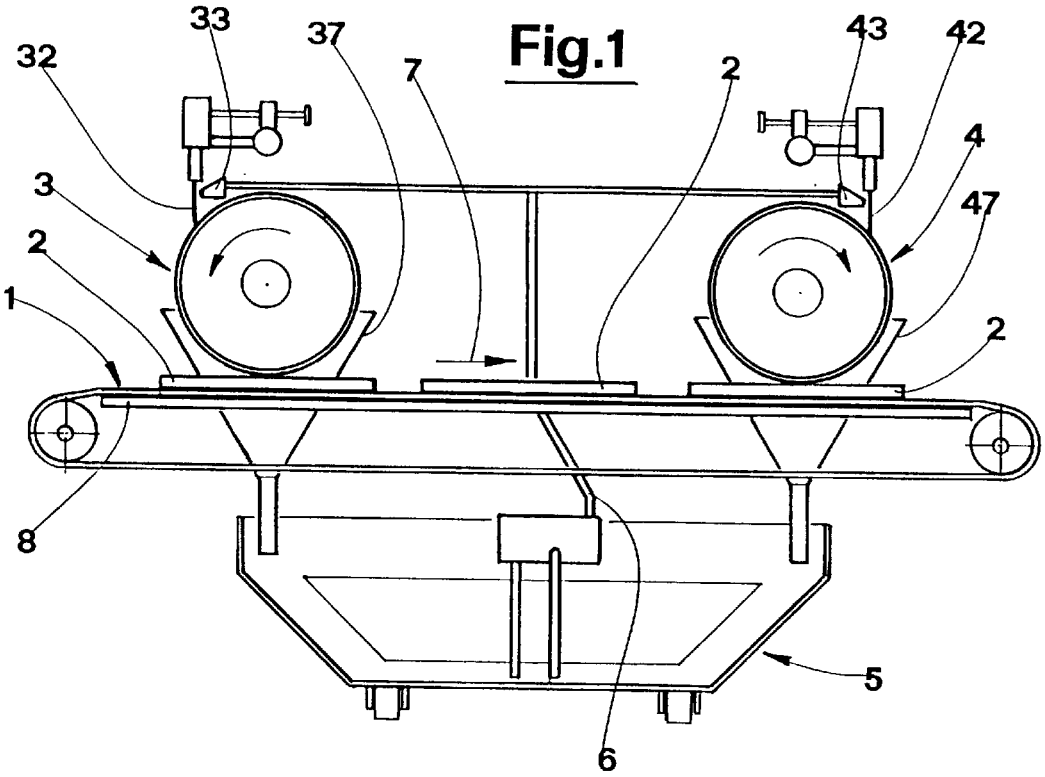
FIG. 1 shows a schematic section made according to line II—II of FIG. 2.

With reference to the above-mentioned figures, 1 schematically denotes a mobile rest plane for ceramic tiles 2 on which the tiles are transferred in the direction indicated by arrow 7.

The rest plane 1 can be constituted by a known-type usual conveyor belt running on a plane 8.

The rest plane 1 is part of a usual conveyor line, for example a belt-type line for ceramic tiles 2.

A rotary glazing apparatus is situated above the rest plane 1, which apparatus comprises two axially-rotating cylinders or rollers 3 and 4 having parallel axes.

The two cylinders 3 and 4 have the same structure and are constituted by a rigid core on which an elastically deformable external cylindrical surface is predisposed. In particular, the elastically deformable part comprises an internal layer of spongy substance, having a high level of elastic deformability and a more compact external layer, also elastically deformable.

Preferably the internal layer is made of a silicone-type spongy material, while the external layer is made of a polymerised (by poly-addition) silicone rubber.

The two cylinders 3 and 4 exhibit, at both ends thereof, crowns 35 and 45 having the same diameters as the respective smooth external cylindrical surfaces 30 and 40 with which they are coaxial. The crowns 35 and 45 are provided with annular channels 36 and 46 which run along the entire peripheral surface of the crowns themselves. Glaze collection trays 37 and 47 are situated below the downwards-facing side of the annular channels 36 and 46 of the crowns 35 and 45. The trays are inferiorly provided with pipes or conduits leading to a collection container 5 situated therebelow, at the bottom of which is situated a conduit 6 feeding glaze distribution organs 33 and 43, which feed the glaze on to the smooth external cylindrical surfaces 30 and 40 of the cylinders 3 and 4.

A plurality of tiny cells 31 and 41 is afforded in the smooth external cylindrical surfaces 30 and 40 which collect and house tiny quantities of glaze.

The cells 31 and 41 are uniformly distributed over pre-established portions of the smooth external cylindrical surfaces 30 and 40.

Two doctors 32 and 42 are arranged contactingly along generatrices of the smooth external cylindrical surfaces 30 and 40 and operate on said surfaces 30 and 40. The doctors 32 and 42 oscillate alternatingly in a parallel direction to the direction of the cylinder 3 and 4 axes. The alternating drive is provided by known means (not illustrated). The doctors 32 and 42 have the objective of distributing and scraping the glaze which is introduced on to the smooth external cylindrical surfaces 30 and 40 by distributing devices 33 and 43 so as to obtain an optimum glaze distribution and refilling of the cells 31 and 41, and consequently very thin layers of glaze 34 and 44 thereon. The doctors 32 and 42 have the further important function of "freshening up" the glaze, enabling it to be constantly stirred and renewing the glaze at least partially each time the cylinders 3 and 4 make a full rotation.

The doctors 32 and 42 are supported on devices which enable the pressure at which the blade of the doctor is pressed against the external cylindrical surface of the respective cylinder to be regulated.

Both the cylinder 3 and the cylinder 4 are predisposed on supports which enable their position to be regulated with respect to the rest plane 1, so that the pressure at which the cylinders are pressed against the transiting tiles 2 on the rest plane 1 can be graduated.

The cylinder 3 is provided with a rotary motion, denoted by the arrow 38, so that the smooth external cylindrical surface 30 also rotates, without dragging and with a pre-established pressure, on the upper surface of a tile 2 transiting on the line 1.

The cylinder 4 is also provided with a rotary motion, the direction of which is indicated by arrow 48, and is such that the smooth external cylindrical surface 40 thereof rolls, at a pre-established pressure, on the upper surface of a tile 2 which has already passed beneath the cylinder 3 transiting on the rest plane 1. In particular, the smooth external cylindrical surface 40 drags on the upper surface of the tile with which it comes into contact due to the fact that it rotates in an opposite direction to the direction of the transiting tile 2.

The cylinder 3 has the sole task of depositing a layer of glaze on an upper surface of a tile passing beneath. In particular, the glaze laid is contained in the cells 31 and the very thin layer predisposed on the smooth external cylindrical surfaces 30 by the action of the doctor 32.

Cylinder 4, on the other hand, has the task of finishing the glazing operation, in the sense that while it lays at least a part of the glaze contained in the cells on its smooth external cylindrical surfaces 40 on the tiles, the fact that the direction it is rotating in is opposite to the transit direction of the tiles 2 causes a sort of redistribution to be carried out on the upper surface of the tiles 2, so that the resulting layer of glaze thereon is uniform.

Figure 2:
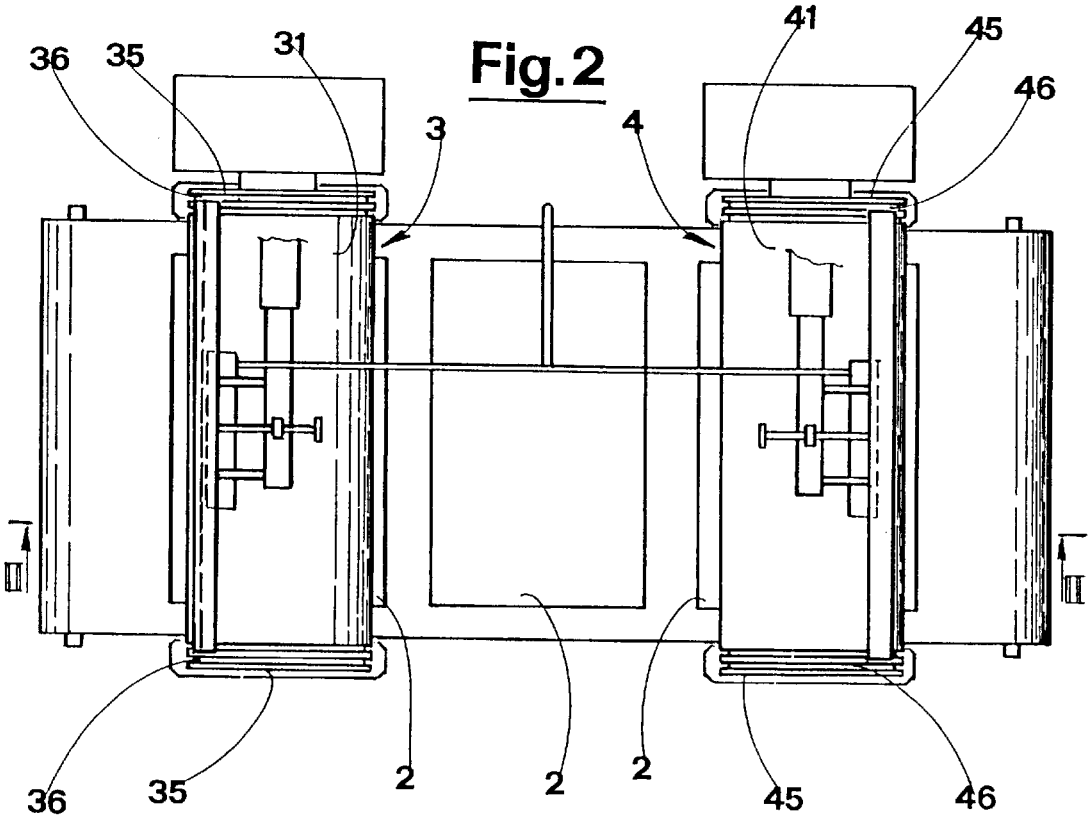
FIG. 2 is a schematic plan view from above of FIG. 1.

As is clearly seen in FIGS. 1 and 2, the arrangement of the first cylinder 3, the first doctor 32, and the glaze distribution organ 33 is essentially a mirror-image of the arrangement of the second cylinder 4, second doctor 42, and glaze distribution organ 43.

The fact that the cylinder 4 lays a quantity of glaze is necessary in order to mix and engage the glaze already deposited on the tile surface by the cylinder 3.

The machine illustrated herein makes possible a laying of a uniform and perfectly smooth layer of glaze on a flat surface of a tile without any need to provide a cleaning-up and edging operation on the edges of the tile, inasmuch as no excess of glaze builds up on said edges.

Figure 3:
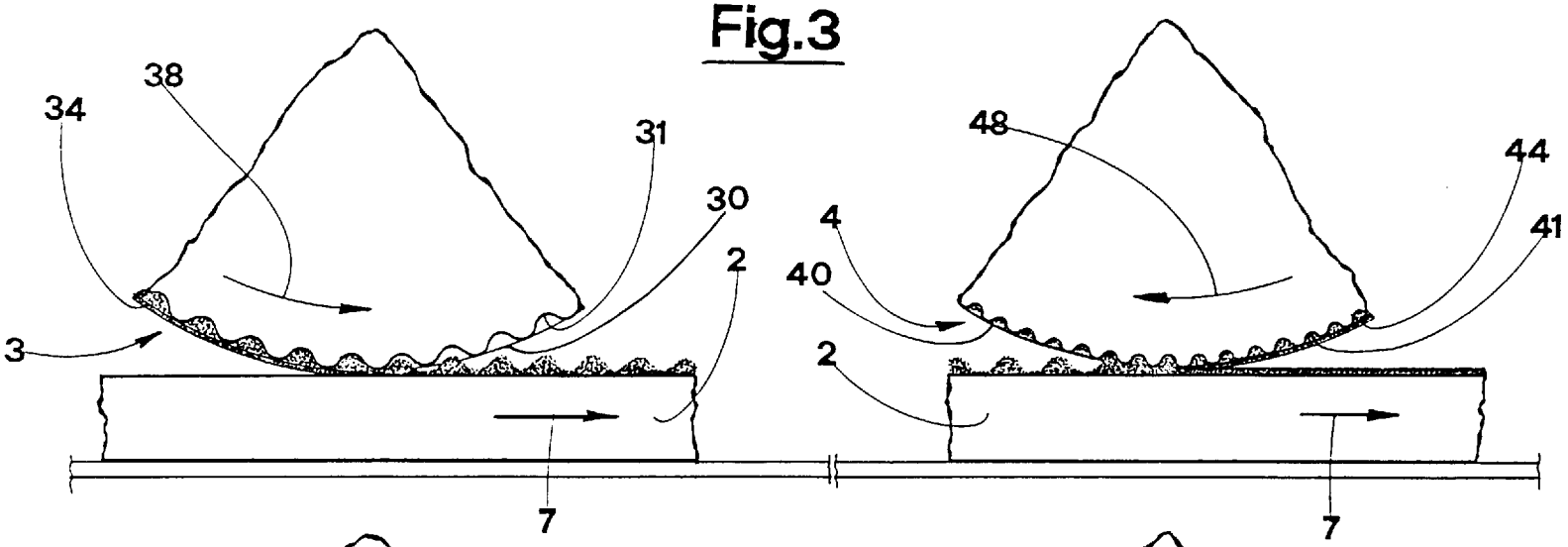
FIG. 3 is an enlarged-scale schematic view of a detail of a section made according to line II—II of FIG. 2, relating to a first embodiment of the invention.

FIG. 3 schematically demonstrates the action of the two cylinders 3 and 4 on the tiles 2, the upper surface of which tiles 2 must be completely glazed.

Figure 4:
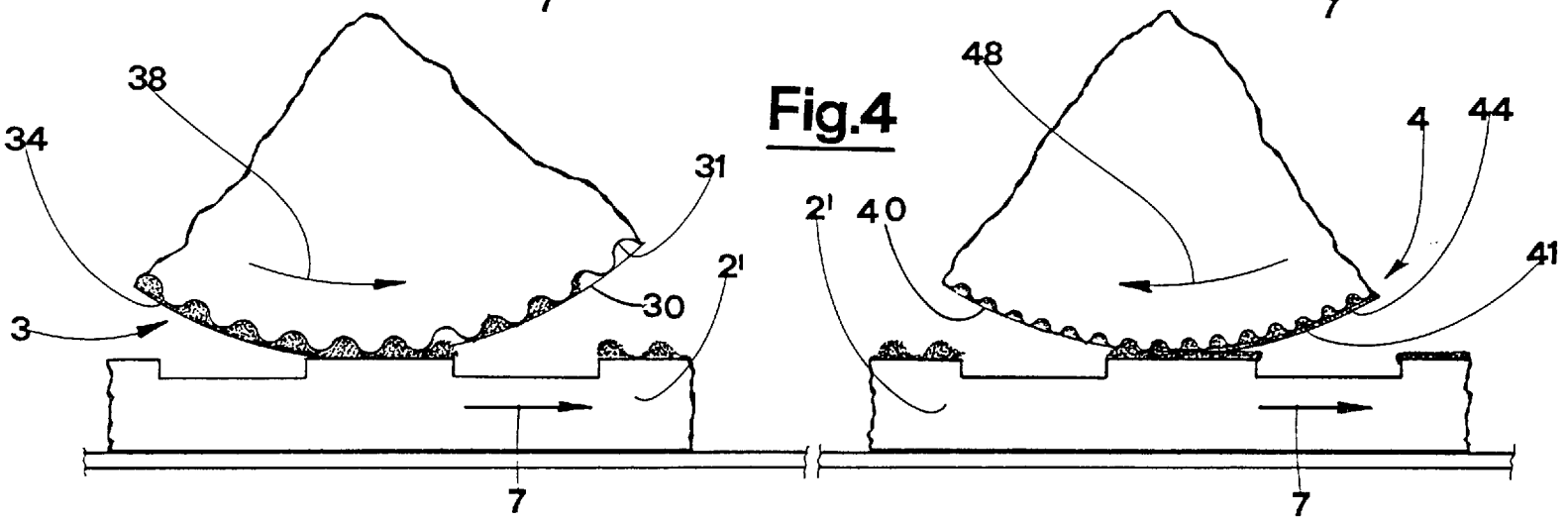
FIG. 4 is the same section as in FIG. 3 relating to a second embodiment of the invention.

FIG. 4 schematically shows a glazing of reliefs arranged on tiles 2' not exhibiting a uniform flat surface. This might be constituted by tiles having reliefs and, obviously, recesses, with the aim of simulating a mosaic effect. In such situations the cylinder pressure on the tiles 2' can be regulated so that the cylinder 3 deposits glaze only in the zones in relief of the tiles 2', while the cylinder 4 comes into contact and carries out its finishing task only and always on the same zones, also depositing small quantities of glaze on the edges of the relief surfaces.

Figure 5:
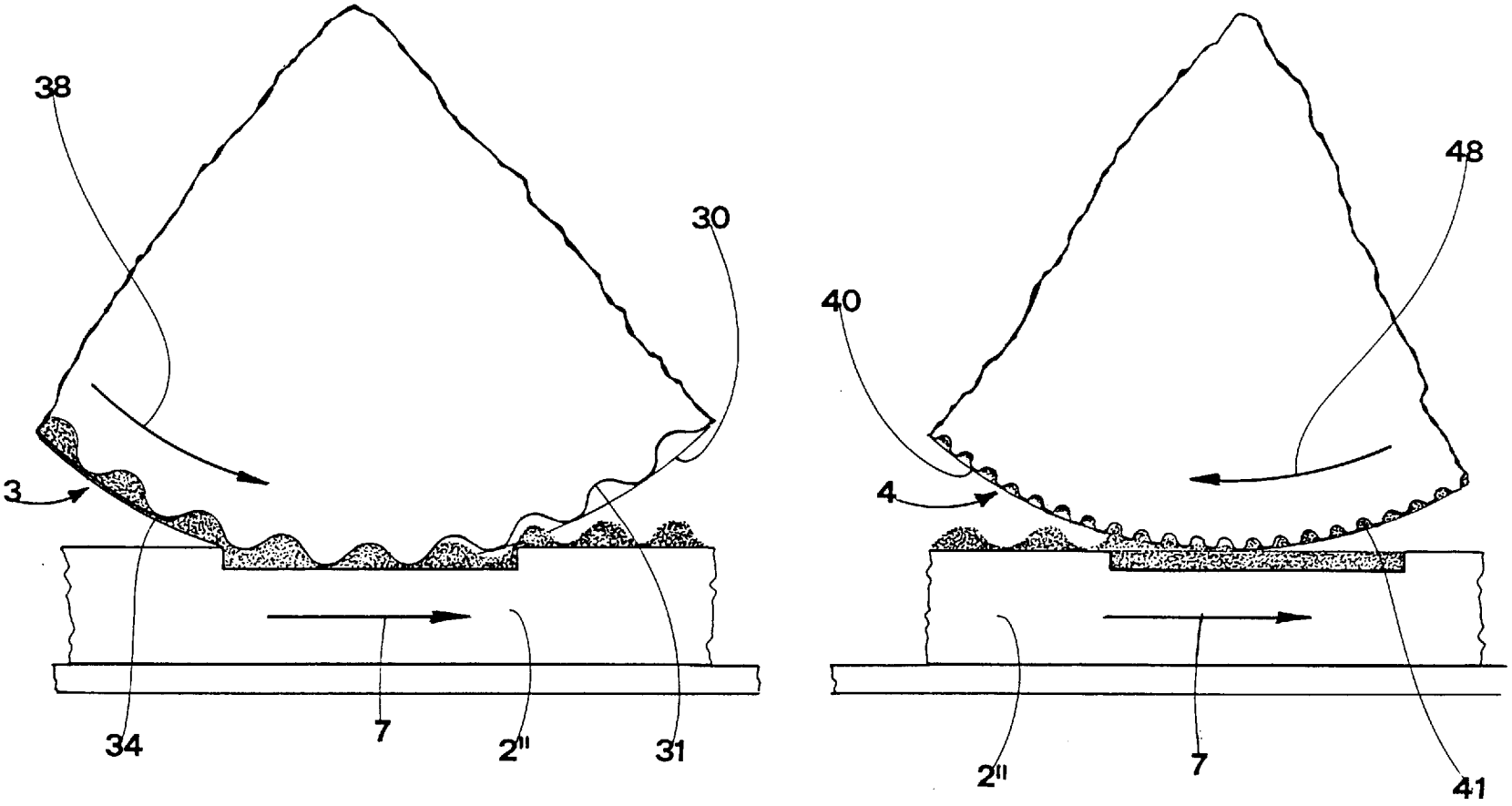
FIG. 5 is the same section as in FIG. 3 relating to a third embodiment of the invention.

A further application of the invention might be achieved by filling cavities on the tile surfaces with glaze. This situation is illustrated in FIG. 5, wherein tiles 2" exhibit cavities which are to be filled with glaze. In this case the cylinder 3 deposits glaze indiscriminately over the entire upper surface of the tile 2" and therefore also internally of the cavities, while cylinder 4, which rotates in an opposite direction, acts as a scraper roller, levelling the glaze predisposed internally of the cavities in the tile 2" and removing glaze almost totally from the upper zones in relief. In order that the tiles 2, 2' and 2" subjected to the action of the cylinder 4 stay put on the rest plane 1 from which they are translated (and continue normally their motion, without being stopped or slowed), the rest plane 1 could be constituted by a continuous surface, but including rest zones set side-by-side with empty zones, and in the contact zone between the second cylinder 4 and the tiles 2, 2' and 2" there could be a depression area operating on the tiles in contact with said second cylinder 4 and causing the tiles 2 2' and 2" to adhere strongly to the rest zones of said rest plane 1.

The above depression area could also be made at the zone at which the roller 3 operates so that the tiles 2, 2', 2" subjected to the roller 3 action remain in perfect adherence to the rest plane 1, from which they are translated, so as to continue their motion normally.

The above-described machine enables a glazing method for ceramic tiles to be actuated which comprises the following phases:

laying of glaze on the elastically deformable smooth external cylindrical surface 30 of a first cylinder 3 on which a plurality of cells 31 is afforded;

removal of any excess of glaze deposited on said smooth external cylindrical surface 30 by means of a doctor 32 which is predisposed so as to enable, apart from filling the cells 31, a thin predetermined layer of glaze 34 to be laid on said surface;

transfer of the glaze contained in said cells 31 and laid on said smooth external cylindrical surface 30 by undragging rolling on said surface 30 over at least a part of an underlying surface of a tile 2,2' 2";

laying of glaze on the elastically deformable smooth external cylindrical surface 40 of a second cylinder 4, on which a plurality of cavities 41 is afforded;

removal of an excess of glaze laid on said smooth external cylindrical surface 40 by means of a doctor 42, which is predisposed in such a way as to permit, apart from a filling of the cells 41, a laying of a thin layer of glaze 44, of a predetermined thinness, on the surface of the tile 2, 2' 2";

at least a partial transfer of the glaze contained in the cells 41 and laid on said smooth external cylindrical surface 40 by means of a dragging rotating motion in relation to the surface 40 over at least part of the upper surface of said tile 2, 2', 2" onto which a layer of glaze has previously been laid by said first cylinder 3.

The invention enables a uniform layer of glaze to be obtained on the tile surface and requires no cleaning of the tile edges.

Furthermore, the invention enables glaze to be deposited both on relief surfaces of the tile, without involving the recesses thereon, and vice versa.

What is claimed:

1. A rotary glazing machine for glazing ceramic tiles, comprising:

a mobile rest plane for the tiles on which the tiles are translated according to a pre-established direction;

a rotary glazing apparatus positioned above said rest plane;

wherein said rotary glazing apparatus comprises:

a first cylinder, mobile in rotation about an axis thereof, having a peripheral part which is elastically deformable, and provided with a smooth external cylindrical surface made of an elastomer material on which a plurality of cells is afforded; said first cylinder being driven to rotate about said axis thereof and being positionable with respect to said rest plane in such a way that said cylindrical surface can roll undraggingly and with a predetermined pressure on an upper surface of a tile transiting on said rest plane;

at least a first doctor predisposed to operate on the cylindrical surface of said first cylinder;

a second cylinder, mobile in rotation about an axis thereof, having at least a peripheral part which is elastically deformable, and provided with a smooth external cylindrical surface made of an elastomer material, on which surface a plurality of cells is afforded; said second cylinder being disposed parallel to said first cylinder and being driven to rotate about said axis thereof, and being positioned with respect to said rest plane in such a way that said cylindrical surface can roll draggingly and with a predetermined pressure on an upper surface of a tile transiting on said rest plane;

at least a second doctor predisposed to operate on said cylindrical surface of said second cylinder;

further comprising glaze distribution organs located upstream of said first and second doctors for depositing glaze on said cylindrical surfaces of said first and second cylinders.

2. The machine of claim 1, wherein said second cylinder is rotatable about said axis thereof so that the smooth external cylindrical surface thereof rotates at a predetermined velocity in an opposite direction to a direction of a tile transiting therebelow and contacting the tile.

3. The machine of claim 2, wherein said first and second doctors are oscillatable alternatingly and parallel to said axes of said first and second cylinders and are regulatable with respect to the smooth external cylindrical surfaces thereof so as to enable a predetermined thin layer of glaze to be deposited thereon and to fill the cells.

4. The machine of claim 3, wherein said mobile rest plane comprises means for keeping said tile in adherence on rest zones of said mobile rest plane.

5. The machine of claim 2, wherein said mobile rest plane comprises means for keeping said tile in adherence on rest zones of said mobile rest plane.

6. The machine of claim 2, wherein said first and second cylinders include, at both ends thereof, crowns having a same diameter and being coaxial with the external smooth cylindrical surfaces; said crowns including external annular channels.

7. The machine of claim 2, wherein said first cylinder, said first doctor, and one of said glaze distribution organs are disposed in a mirror-image arrangement to said second cylinder, said second doctor, and another one of said glaze distribution organs.

8. The machine of claim 1, wherein said first and second doctors are oscillatable alternatingly and parallel to said axes of said first and second cylinders and are regulatable with respect to the smooth external cylindrical surfaces thereof so as to enable a predetermined thin layer of glaze to be deposited thereon and to fill the cells.

9. The machine of claim 8, wherein said mobile rest plane comprises means for keeping said tile in adherence on rest zones of said mobile rest plane.

10. The machine of claim 1, wherein said mobile rest plane comprises means for keeping said tile in adherence on rest zones of said mobile rest plane.

11. The machine of claim 7, comprising, arranged below annular channels of crowns, collection trays for the glaze which are inferiorly provided with pipes or conduits leading to an underlying collection container from which originates an end of a conduit supplying said organs of glaze distribution.

12. The machine of claim 1, wherein said first and second cylinders include, at both ends thereof, crowns having a same diameter and being coaxial with the external smooth cylindrical surfaces; said crowns including external annular channels.

* * * * *